US011026554B2

(12) United States Patent
Peters, Jr.

(10) Patent No.: US 11,026,554 B2
(45) Date of Patent: Jun. 8, 2021

(54) CONVENIENT SPOT REMOVER FOR DIRTY CARPET SPOTS

(71) Applicant: Douglas Elwood Peters, Jr., Loganville, GA (US)

(72) Inventor: Douglas Elwood Peters, Jr., Loganville, GA (US)

( * ) Notice: Subject to any disclaimer, the term of this patent is extended or adjusted under 35 U.S.C. 154(b) by 94 days.

(21) Appl. No.: 16/197,809

(22) Filed: Nov. 21, 2018

(65) Prior Publication Data

US 2020/0154971 A1 May 21, 2020

(51) Int. Cl.

| | |
|---|---|
| ***A47L 13/26*** | (2006.01) |
| ***A43B 5/04*** | (2006.01) |
| ***A43B 11/00*** | (2006.01) |
| ***A46B 5/04*** | (2006.01) |
| ***A43B 13/14*** | (2006.01) |
| ***A43B 3/00*** | (2006.01) |
| ***A46B 11/00*** | (2006.01) |

(52) U.S. Cl.

CPC ..... *A47L 13/26* (2013.01); *A43B 3/00* (2013.01); *A43B 13/141* (2013.01); *A46B 5/04* (2013.01); *A46B 11/0072* (2013.01)

(58) Field of Classification Search

CPC ..... A47L 13/26; A43B 3/00; A43B 13/141; A46B 5/04; A46B 11/0072

USPC ..... 15/49.1

See application file for complete search history.

(56) References Cited

U.S. PATENT DOCUMENTS

| | | | | | |
|---|---|---|---|---|---|
| 599,495 | A * | 2/1898 | Durel et al. | A46B 5/02 | 15/143.1 |
| 2,034,661 | A * | 3/1936 | McCauley | A47L 13/26 | 401/285 |
| 2,784,436 | A * | 3/1957 | Peterson | A47L 13/282 | 15/227 |
| 3,101,506 | A * | 8/1963 | Himes | A47L 13/26 | 401/22 |
| 3,104,413 | A * | 9/1963 | Nelson | A47L 13/26 | 401/21 |
| 3,362,775 | A * | 1/1968 | Muecke | A47L 13/282 | 401/6 |
| 3,526,014 | A * | 9/1970 | Edwards | A47L 13/282 | 15/227 |
| 3,648,696 | A * | 3/1972 | Keith | A61D 1/02 | 604/310 |
| 3,680,170 | A * | 8/1972 | Sims | A47L 13/282 | 15/227 |
| 5,833,675 | A * | 11/1998 | Garcia | A61M 3/0262 | 604/310 |
| 6,052,856 | A * | 4/2000 | DeMoya | A47L 13/12 | 15/227 |
| 6,092,313 | A * | 7/2000 | Dunlap | A43B 3/00 | 36/132 |

(Continued)

*Primary Examiner* — Weilun Lo

(74) *Attorney, Agent, or Firm* — Dunlap Bennett & Ludwig, PLLC

(57) ABSTRACT

A leg-driven cleaning system embodying cleaning footwear device fluidly connected to cleaning solution is provided. The cleaning footwear includes cleaning bristles along an underside thereof, as well as a nozzle adjacent to the underside for selectively applying the cleaning solution while a wearer of the cleaning footwear device utilizes their leg strength to wipe their feet to scrub their carpet clean. The leg-driven cleaning system does not take up much room, is easy to store, is very cost effective, and anyone from the ages seven to ninety can operate.

10 Claims, 3 Drawing Sheets

(56) References Cited

U.S. PATENT DOCUMENTS

| | | | | |
|---|---|---|---|---|
| 6,935,579 | B1 * | 8/2005 | Lindsey | A47L 13/23 119/604 |
| D573,797 | S * | 7/2008 | Guillaume | D4/119 |
| 7,845,043 | B2 * | 12/2010 | McLogan | A43B 3/00 15/227 |
| D653,455 | S * | 2/2012 | Cynewski | D2/898 |
| 9,198,503 | B1 * | 12/2015 | Rieger | A46B 11/00 |
| 9,723,914 | B2 * | 8/2017 | Connelly | A46B 15/0055 |
| 2005/0150067 | A1 * | 7/2005 | Cobabe | A46B 15/0002 15/22.1 |
| 2006/0265828 | A1 * | 11/2006 | Mallatt | A46B 5/04 15/227 |
| 2013/0263398 | A1 * | 10/2013 | Irwin | A47L 13/22 15/228 |

* cited by examiner

CONVENIENT SPOT REMOVER FOR DIRTY CARPET SPOTS

BACKGROUND OF THE INVENTION

The present invention relates to carpet cleaning systems and, more particularly, to a leg-driven cleaning system.

Cleaning carpets and floors typically requires bending or stooping over in order to scrub or brush, even when using a device with an extended handle. Moreover, to get out tough-to-remove stains, users have to typically get on your hands and knees. Either way, users of current carpet cleaning devices are at least stooping and using a lot of arm motion. And so, if the user has bad shoulders or back, the current approaches to cleaning carpets and floors can be prohibitively painful.

As can be seen, there is a need for a leg-driven device for cleaning floors and carpets and a method for using the same that does not require stooping over, arm motion, or even using upper body strength. It is important to note that the legs are stronger than the arms of a person, and thus a leg-driven cleaning device enabling the power of a user's lower body to do the work, through leg and foot motion, would be a boon for a user with upper body, shoulder or back weakness or pains.

The leg-driven floor and carpet cleaning device is embodied in a systemic footwear allowing a wearer to stand and scrub with foot action like wiping one's feet. A source of cleaning solution may be fluidly connected to the underside of the footwear providing a spray nozzle for dispensing the cleaning solution from said underside, further eliminating the need for the wearer to stoop or bend over during the cleaning process.

SUMMARY OF THE INVENTION

In one aspect of the present invention, a leg-driven cleaning system includes the following components: a cleaning footwear device dimensioned and adapted to be worn on a foot of a human user; a plurality of bristles extending from an underside of the cleaning footwear device; and a spray nozzle connected to or adjacent to said underside.

In another aspect of the present invention, the leg-driven cleaning system includes the following components: a cleaning footwear device dimensioned and adapted to be worn on a foot of a human user; a plurality of bristles extending from an underside of the cleaning footwear device; a spray nozzle connected to or adjacent to said underside; a fluid connection fluidly connecting the spray nozzle and a cleaning solution source; and a leg connector for securing the fluid connection to the human user's leg.

In yet another aspect of the present invention, a method of cleaning a carpet in situ on a floor completely or substantially by way of leg-driven power, includes the following steps: wearing at least one cleaning footwear device of claim 2 on one foot; moving said one foot in a foot-wiping motion along an upper surface of the carpet so that the plurality of cleaning bristles engage said upper surface, wherein the user selectively urges the cleaning solution source through the spray nozzle before the foot-wiping motion.

These and other features, aspects and advantages of the present invention will become better understood with reference to the following drawings, description and claims.

DETAILED DESCRIPTION OF THE INVENTION

Figure 1:
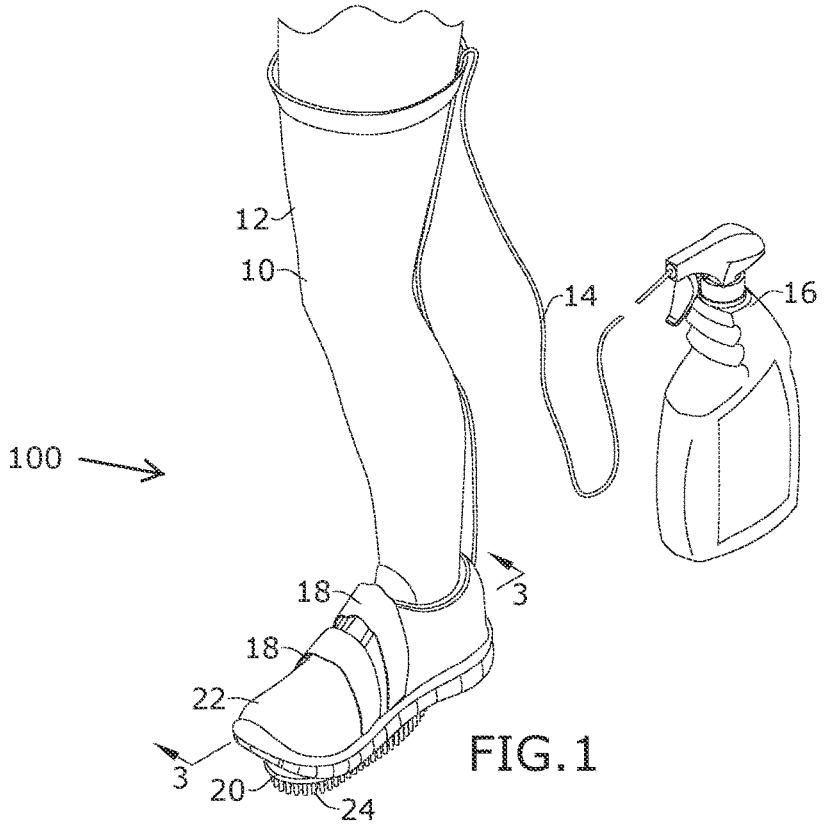
FIG. 1 is a perspective view of an exemplary embodiment of the present invention, shown in use.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a leg-driven cleaning system embodying cleaning footwear device fluidly connected to cleaning solution. The cleaning footwear provides cleaning bristles along an underside thereof, as well as a nozzle adjacent to the underside for selectively applying the cleaning solution while a wearer of the cleaning footwear device utilizes their leg strength to wipe their feet to scrub their carpet and/or floors clean.

Referring to FIGS. 1 through 5, the present invention may include a leg-driven cleaning system 100 embodying carpet-cleaning footwear 22 dimensioned and adapted to be worn on the foot of a human user. Along an underside 34 of the footwear cleaning 22 may be a plurality of cleaning bristles 24. The cleaning bristles 24 are integrated with the underside 34, in certain embodiments via a base 20, making the plurality of bristles 24 and the carpet-cleaning footwear 22 a unitary piece.

Figure 2:
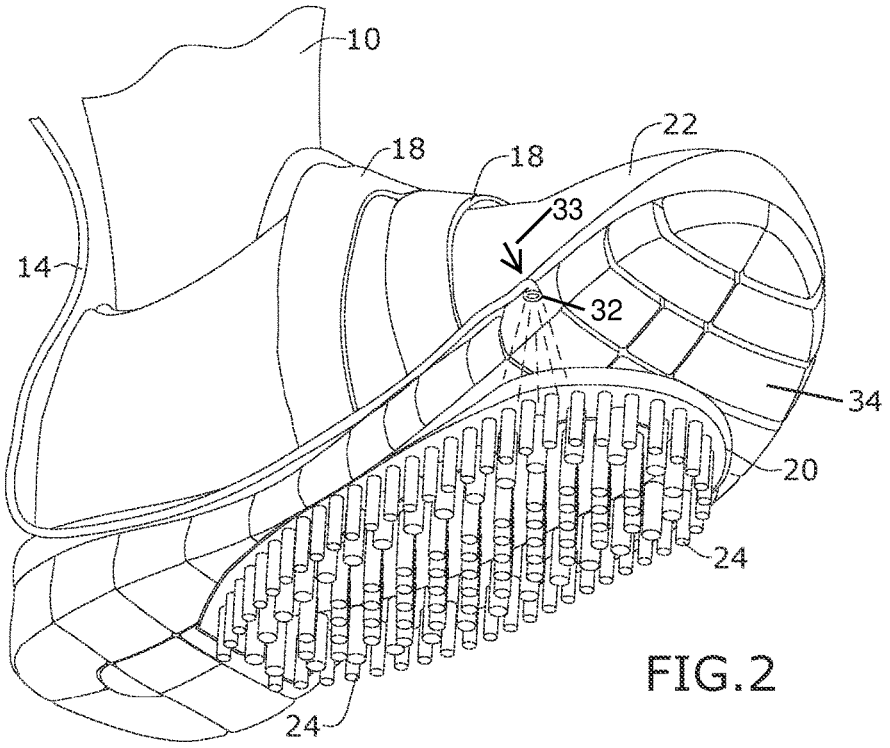
FIG. 2 is a bottom perspective view of an exemplary embodiment of the present invention.
Figure 3:
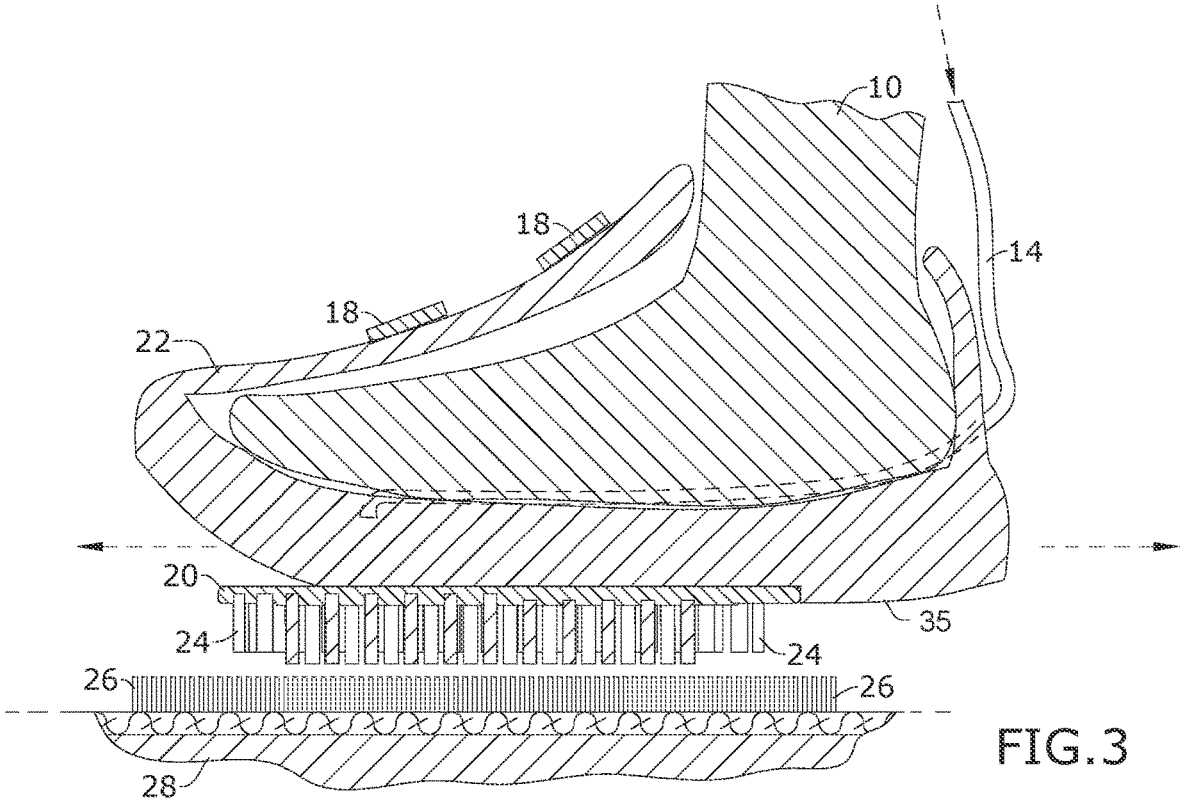
FIG. 3 is a section view of an exemplary embodiment of the present invention, taken along line 3-3 in FIG. 1, illustrating leg-driven scrubbing-wiping action.
Figure 4:
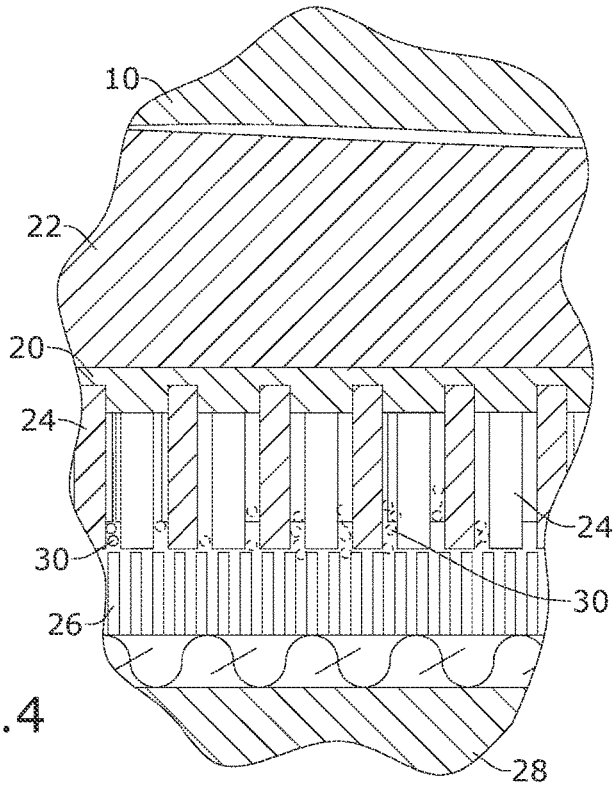
FIG. 4 is a detailed section view of an exemplary embodiment of the present invention, illustrating the agitated interactive condition 30 resulting from the scrubbing-wiping action.
Figure 5:
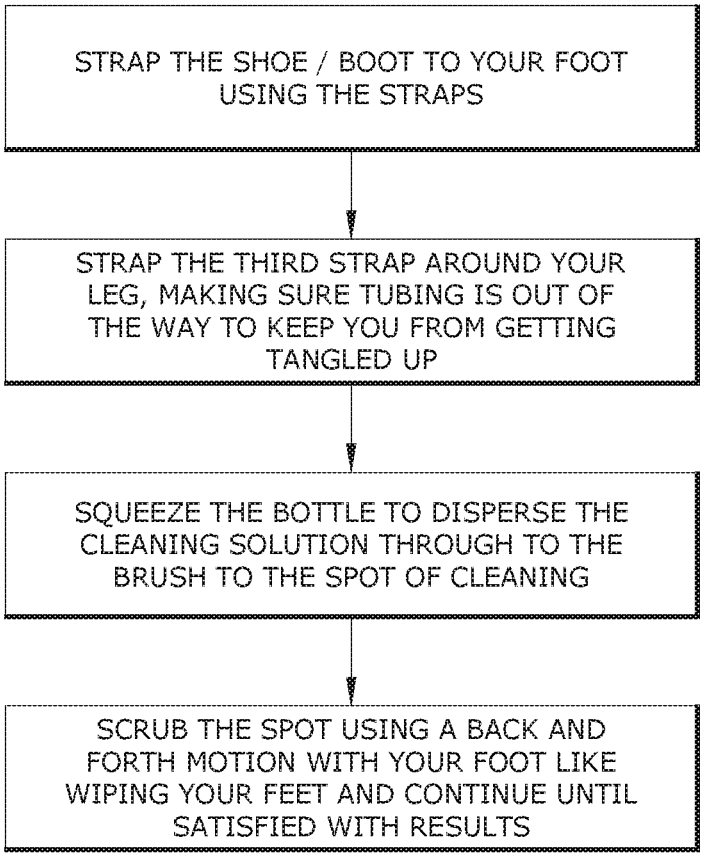
FIG. 5 is a detail perspective view of an exemplary embodiment of the present invention.

A spray nozzle 32 may be disposed along or adjacent to the underside 34. A fluid connection 14 may fluidly connect the spray nozzle 32 to a cleaning solution source 16. A portion of the fluid connection 14 may be connected along a periphery of the underside 34, as illustrated in FIG. 2. The fluid connection 14 may extend up the leg of the user 10, and may even be secured thereto by way of a leg connector 12, keeping the fluid connection 14 out of the way during use. The connectors 12 and 18 may be straps or other methods of removably connecting one object to another. The connectors 12 and 18 may incorporate a detachable fastener, such as hook and loop fasteners or the like for this purpose.

The cleaning solution source 16 may be a conventional spray bottle, thereby enabling the user 10 to utilize the present invention with such ubiquitous cleaning products, including their favorite carpet cleaning solution squirt bottle. The fluid connection 14 may provide an object to be able to snap on another squirt bottle of solution when needed.

The fluid connection 14 may be clear flexible tubing being $3/16^{th}$ of an inch in diameter and approximately 50 inches in length. A plug (not shown) may be dimensioned to fit into the fluid connection/tubing 14 to keep from leaking when not in use. There may be a white arrow an arrow 33 at or adjacent to the tip of the footwear 22 that shows where the liquid cleaner comes out of the nozzle 32, so that the user may point their toe at the spot on the carpet 26 and squirt.

The footwear 22 may be a surgical boot; typically, having a poly-cotton blend upper portion allowing the foot to breathe and provides added comfort. The footwear 22 may have a semi-rigid sole provides superior protection and control, and adapted to fit either foot. The footwear 22 may include a reinforced heel 35 and heel counter and padded heel collar providing more stability overall to the rear of the foot.

A method of using the present invention may include the following. The leg-driven cleaning system 100 disclosed above may be provided. The cleaning footwear provides a convenient method for removing spots by using one's lower body strength while scrubbing your foot back and forth like wiping one's feet. This scrubbing-wiping motion would cause the cleaning solution into an agitated interactive condition 30 within the fibers of the carpeting 26 thoroughly cleaning it.

So easy a young child can use it. No electricity needed. And so, people with a bad back and/or shoulders, such as older people who cannot bend down, can utilize the leg-driven cleaning system 100 to clean up a few spots without having to pull out the bulky and heavy steam cleaner. The user's own weight could provide sufficient force, sandwiching the carpet 26 to the supporting floor 28 during the cleaning process.

Such individuals could sit in a chair, slip on the cleaning footwear 22 and go to work on those stubborn spots, applying "knee grease" as opposed to elbow grease. No batteries, no plugging into the wall, no electricity, one only needs lower body strength.

It should be understood, of course, that the foregoing relates to exemplary embodiments of the invention and that modifications may be made without departing from the spirit and scope of the invention as set forth in the following claims.

What is claimed is:

1. A leg-driven carpet spot cleaning system, comprising:
a cleaning footwear device dimensioned and adapted to be worn on a foot of a human user;
the cleaning footwear device comprising an underside defined by a sole interfacing a heel so that a front face of the heel extends downward of the sole;
a base connected to the sole and reinforced by the front face of the heel;
a plurality of bristles extending from the base; and
a spray nozzle connected outside a periphery of the underside,
whereby the human user can selectively target one or more spots along the carpet for cleaning or removing said one or more spots.

2. The leg-driven carpet spot cleaning system of claim 1, further comprising a fluid connection fluidly connecting the spray nozzle and a cleaning solution source.

3. The leg-driven carpet spot cleaning system of claim 2, wherein the cleaning solution source is a squirt bottle.

4. The leg-driven carpet spot cleaning system of claim 1, wherein the plurality of cleaning bristles is integrated with said base.

5. The leg-driven carpet spot cleaning system of claim 2, further comprising a leg connector/ safety strap for securing the fluid connection to the human user's leg.

6. A leg-driven carpet spot cleaning system, comprising:
a cleaning footwear device dimensioned and adapted to be worn on a foot of a human user;
the cleaning footwear device comprising an underside defined by a sole interfacing a heel so that a front face of the heel extends downward of the sole;
a base connected to the sole and reinforced by the front face of the heel;
a plurality of bristles extending from the base;
the plurality of bristles comprise:
a plurality of first bristles adjacent to a periphery of the base, wherein each first bristle has a first length; and
a plurality of second bristles generally circumscribed by the plurality of first bristles, wherein each second bristle has a second length shorter than the first length for causing a cleaning solution into an agitated interactive condition within a plurality of fibers of a carpet;
a spray nozzle connected outside a periphery of the underside;
an arrow on the cleaning footwear device adjacent said spray nozzle;
a fluid connection directly connecting the spray nozzle and the cleaning solution for selectively dispersing the cleaning solution in spray form to target one or more carpet spots; and
a leg connector for securing the fluid connection to the human user's leg.

7. The leg-driven carpet spot cleaning system of claim 6, wherein the cleaning solution source is a squirt bottle.

8. The leg-driven carpet spot cleaning system of claim 6, wherein the plurality of cleaning bristles is integrated with said base.

9. A method of cleaning a carpet spot completely or substantially by way of leg-driven power, comprising the steps of:
wearing a carpet cleaning footwear device on one foot;
the carpet cleaning footwear device comprising:
an underside defined by a sole interfacing a heel so that a front face of the heel extends downward of the sole;
a base connected to the sole and reinforced by the front face of the heel;
a plurality of bristles extending from the base;
the plurality of bristles comprise:
a plurality of first bristles adjacent to a periphery of said base, wherein each first bristle has a first length; and
a plurality of second bristles generally circumscribed by the plurality of first bristles, wherein each second bristle has a second length shorter than the first length for causing a cleaning solution into an agitated interactive condition within a plurality of fibers of a carpet;
a spray nozzle connected outside said periphery of the underside;
a fluid connection directly connecting the spray nozzle and the cleaning solution for selectively dispersing the cleaning solution in spray form; and
a leg connector for securing the fluid connection to the human user's leg; and
moving said one foot in a foot-wiping motion along the carpet so that the plurality of cleaning bristles engage said carpet.

10. The method of claim 9, further comprising the step of selectively urging the cleaning solution through the spray nozzle before the foot-wiping motion.

* * * * *